United States Patent [19]

Ainoya et al.

[11] 4,008,555

[45] Feb. 22, 1977

[54] APPARATUS FOR PILING ROD-SHAPED ARTICLES IN A CONTAINER

[75] Inventors: Koh Ainoya; Kiichi Arai, both of Tokyo; Akira Kato, Sanjyo; Michio Tanaka, Niigata, all of Japan

[73] Assignees: The Japan Tobacco & Salt Public Corporation; Neo Filter Co., Ltd., both of Tokyo; Sanjo Machine Works Ltd., Minami-kanbara, all of Japan

[22] Filed: Aug. 11, 1975

[21] Appl. No.: 603,602

[30] Foreign Application Priority Data

Aug. 20, 1974 Japan ..... 49-094640

[52] U.S. Cl. ..... 53/148; 53/236

[51] Int. Cl.[2] ..... B65B 19/04; B65B 19/12

[58] Field of Search ..... 53/148, 149, 150, 151, 53/236

[56] References Cited

UNITED STATES PATENTS

| | | | |
|---|---|---|---|
| 3,004,374 | 10/1961 | Pembroke | 53/236 X |
| 3,019,574 | 2/1962 | Johnson et al. | 53/236 X |
| 3,241,286 | 3/1966 | Dearsley | 53/236 X |
| 3,895,479 | 7/1975 | Kastner | 53/236 X |

FOREIGN PATENTS OR APPLICATIONS

| | | | |
|---|---|---|---|
| 1,123,241 | 2/1962 | Germany | 53/148 |

*Primary Examiner*—Robert Louis Spruill

*Attorney, Agent, or Firm*—Woodhams, Blanchard and Flynn

[57] ABSTRACT

An apparatus for piling rod-shaped articles in a container, in which a hopper member having at least one levelling means such as a swing pin is employed in combination with a push means. The rod-shaped articles temporarily collected in the hopper member are pushed out into the container by the push means at least every one layer thereof thereby to make an orderly pile of the rod-shaped articles in the container.

11 Claims, 12 Drawing Figures

APPARATUS FOR PILING ROD-SHAPED ARTICLES IN A CONTAINER

FIELD OF THE INVENTION

The present invention relates to an apparatus for piling rod-shaped articles of fixed size, for example, cigarettes, filter rods, etc., in a container of fixed size, and more particularly to an apparatus for piling rod-shaped articles, wherein the rod-shaped articles which have been successively brought are temporarily collected in an orderly pile in a hopper member and, then, said rod-shaped articles are horizontally pushed into a container by every desired number of layers by means of a push means without disordering the piled-up state.

Hereinafter in the specification "filter-rod" is referred to as an example of the rod-shaped articles.

BACKGROUND OF THE INVENTION

There have been proposed several apparatus for piling up filter rods in a container. (See, Japanese Patent Application Publication Nos. 43-23995, 44-5439, 46-27360 and 47-19759.) However, these apparatus have been made only for the step of feeding filter rods directly into a container through, for example, a belt conveyor, a plurality of guide grooves, a suction plate for sucking up every layer of filter rods, etc. There has been proposed no device for the treatment of the filter rods after they have been carried into a hopper or a container.

In this connection, it should be noted that, according to the conventional methods or apparatus, the number of filter rods piled in a box is not always constant and that there are sometimes formed undesired spaces between filter rods in the box. To prevent the above troubles, there have been taken certain measures, for example, manually vibrating the box and adjusting the number of the filter rods by inserting filter rods one by one into the spaces, which takes much more time. Accordingly there have been caused several social problems such as security of manpower, a wage problem, etc.

A method and an apparatus for orderly and precise piling of filter rods have been eagerly expected in order to efficiently deal with filter rods which are produced at a very high speed, for example 4,000 pieces per hour, and to speedily pack the fixed number of filter rods into a container of fixed size.

The present invention has been made to overcome the conventional disadvantages and to meet the demand as discussed above, and therefore it is a primary object of the present invention to provide an apparatus for piling rodshaped articles such as filter rods, wherein the fixed number of filter rods can be easily and precisely packed in an orderly pile in a container at a high speed.

In one aspect of the present invention there is provided a method for piling up rod-shaped articles in an orderly pile in a container comprising temporarily collecting rod-shaped articles in a hopper member, levelling with distributing the collected rod-shaped articles in an orderly pile in the hopper member, and pushing out in the horizontal direction the rod-shaped articles into the container by means of a push means while maintaining the piled-up state of the rod-shaped articles.

In another aspect of the present invention there is provided an apparatus for piling up rod-shaped articles in an orderly pile in a container comprising a hopper member, a push means adapted to move in the horizontal direction transversing the lower portion of said hopper member, and a means for lowering a container in synchronism with said push means, said hopper member comprising a levelling means for distributing and levelling the rod-shaped articles in the hopper member.

BRIEF DESCRIPTION OF THE DRAWINGS

The invention will be better understood from the following description taken in connection with the accompanying drawings in which.

DETAILED DESCRIPTION

Referring to FIGS. 1 to 9, there is illustrated one embodiment of the present invention.

An apparatus of the present invention is divided into four sections; an empty-box conveyor section (A), a lowering section (B), a packed-box conveyor section (C) and a hopper section (D).

Figure 5A:
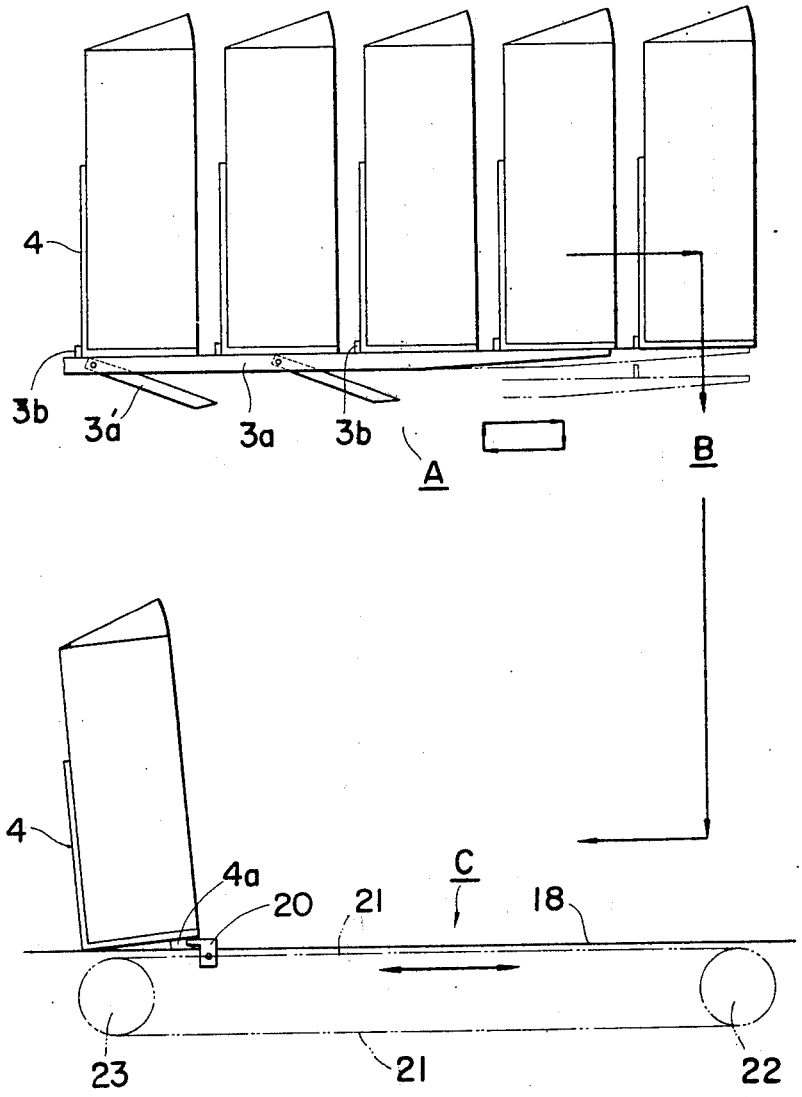
FIG. 5*a* is a semi diagrammatical view, explaining the operation of an empty-box conveying member and a packed-box conveying member.

More detailedly stated, on a base table 1 at its rear portion there is fixedly mounted a conveyor part 2 having a sidewardly opening channel shaped cross section. Said conveyor part 2 comprises an empty-box conveying member 2*a*, a container-lowering means 2*b* and a packed-box conveying member 2*c*. The empty-box conveying member 2*a* comprises a delivery table 3 and, as shown in FIG. 5*a*, a delivery means 3*a*, 3*a'* with a plurality of pins 3*b*. Between adjacent pins 3*b* there is provided a holding means 4 for supporting a box 5, respectively. Said delivery means 3*a*, 3*a'* with a pin 3*b* is adapted to repeat four steps; (1) to move in the horizontal direction through a passage (not shown) formed in the delivery table 3 to carry said holding means 4 one by one towards the lowering section (B), (2) to descend a little, (3) to retreat the same distance as in step (1), and (4) to ascend the same distance as in the step (2) to return to the original position. The pin 3*b* engages with the holding means 4 only in the forward movement, and while the delivery means 3*a*, 3*a'* retreats, the holding means 4 is still kept on the delivery table 3. Therefore, during every one stroke of the four steps of the delivery means 3*a*, 3*a'* one holding means 4 is carried to the lowering section (B). Numeral 5 designates a box of the fixed size fitted in and supported by the holding means 4. An upper wall 5*a* of the box 5 is slightly opened upwards so that filter rods may be surely and easily pushed into the box at the lowering section (B).

Figure 5B:
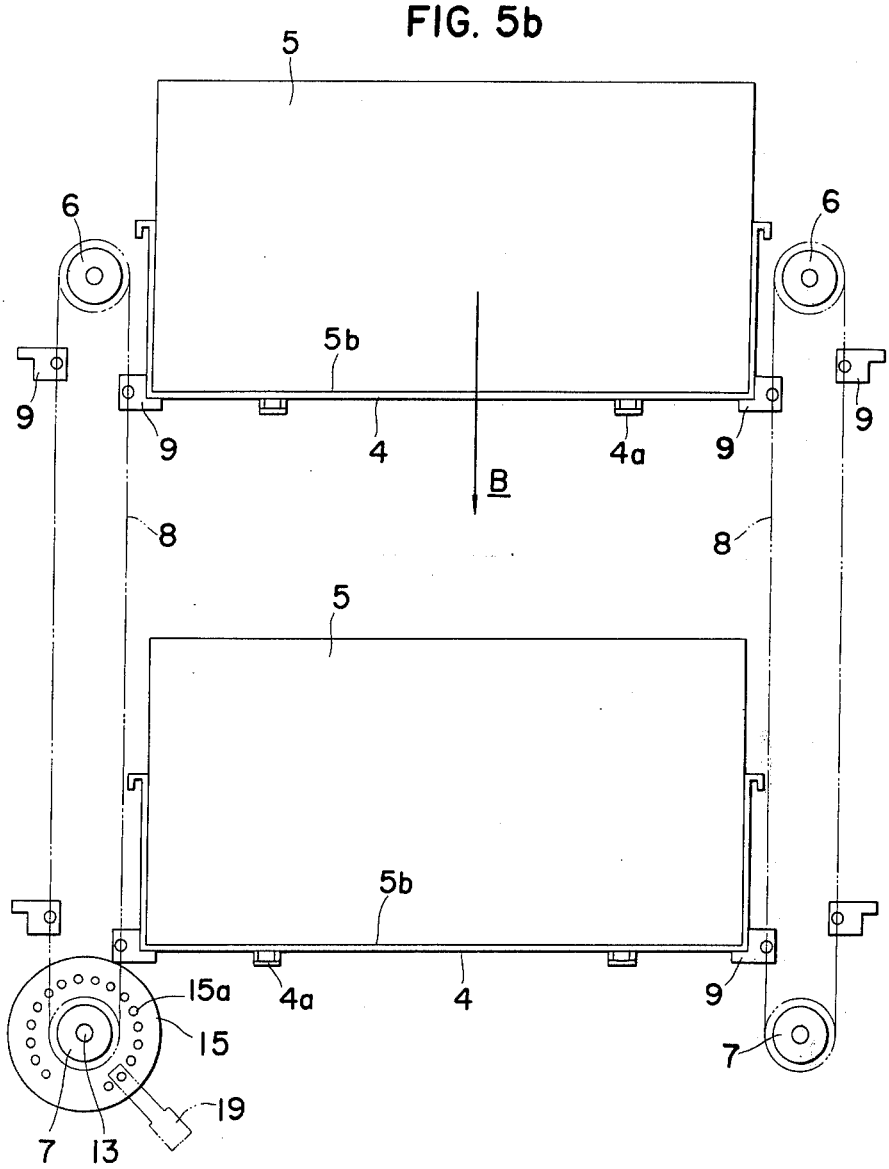
FIG. 5*b* is a semi diagrammatical view, explaining the operation of a means for lowering a container.

The container lowering means 2*b* comprises an upright support means, an upper gear 6 (FIG. 5*b*) and a lower gear 7 which are attached to said support means by some conventional means, and an endless chain 8 wound over said gears. A plurality of catch means 9 are attached to the endless chain 8 at regular intervals as depicted in FIG. 5*b*. Bottom side edges of the holding means 4 holding the box 5 therein are caught by said catch means 9.

There will be illustrated how to start or stop the means 2*b*. In this embodiment filter rods are to be piled in a box in 51 layers (three layers at a time x 17 times). A motor 10 on the base table 1 starts to work just after the protrusion and the retreat of the push means 14 as will be explained hereinafter. The rotation of the motor 10 is transmitted to a gear shaft 13 of the lower gear 7 through a belt, a pulley, a rotary shaft 11 and a gear mechanism 12, thereby to start the container-lowering means 2*b*. A disc 15 (FIG. 2*b*) concentrically fixed to the gear shaft 13 has seventeen small holes 15*a* arranged in the circumferential direction thereof. All the openings 15*a* from the first one to the last one are each arranged at uniform intervals, but only the interval between the last hole and the first one is larger than the others as can be seen from FIG. 5*b*. The movement of the container-lowering means 2*b* is conducted by a photoelectric element 19 which detects and responds to said small openings 15*a*. The interval between the first and the second openings detected by the photoelectric element 19 corresponds to the distance corresponding to the height of three layers of the filter rods, which distance the box covers at one time. And the longer interval between the last and the first openings detected by the photoelectric element 19 corresponds to the interval during which the last (the seventeenth) three layers are pushed into a box and the next empty box sits on a front table 16. When a box is packed with 51 layers (3 × 17) of filter rods, it falls onto a packed-box delivery table 18. Since the holding means 4 has two engaging means 4*a* such as a short leg with an opening at front portions of the bottom surface thereof, the packed-box 5 on the delivery table 18 is inclined at about five degrees in relation with the advance direction. Due to such structure, the filter rods piled in the box 5 will not fall out. In the delivery table 18 there is provided a chain 21 in (FIG. 5*b*) engagement with a gear 22 and a gear 23. An engaging means 20 is fixedly attached to the chain 21 with a conventional means. Said engaging means 20 is adapted to go back and forth through a passage (not shown) formed in the delivery table 18. When the chain 21 with the engaging means 20 moves from the right to the left in FIG. 5*a*, the engaging means 20 engages with the engaging means 4*a* thereby to convey the box 5; and when the chain goes back, the engagement is released to leave the box at the terminal end of the delivery table 18. The gears 22 and 23 start to operate just when the packed box 5 goes down to the packed-box conveyor section (C) and gets on the delivery table 18. The gears 22 and 23 are driven by a motor (not shown). At the terminal end of the delivery table 18, there is provided a micro switch (not shown). The micro switch detects that the holding means 4 reaches its terminal position. At this instance, the chain goes in reverse to move the engaging means 20 back in its original place adjacent the lowering section (B).

Now, there will be illustrated the main characteristic section, the hopper section (D). A hopper member 17 comprises a bottom wall which is a rear part of the front table 16, a back wall 24, both side walls 25 and a transparent front wall 27. Said front wall 27 has an opening at its lower portion for the push means 14 passing therethrough. Said side walls 25 are provided with vibrating plates 26 (FIG. 2) at their insides, respectively. The length and the width of said hopper member 17 are substantially equal to those of the box 5. The back plate 24 has at its lower portion an opening 24*a* (FIG. 6) having a height sufficient for the three layers of filter rods to be pushed therethrough. The hopper member 17 further comprises an upper swing pin 29 fixed to a board 30 and a plurality of lower swing pins 31 fixed to a board 32. The boards 30 and 32 are loosely fitted in the back plate 24, and have substantially the same thickness as the back plate 24 as shown in cross section in FIG. 3.

Each of the boards 30 and 32 is pivotally connected, at its one end, to a T-shaped lever 33 and, at the other end, to a lever 34. The T-shaped lever 33 is pivotally connected at its middle portion of one side to a pin 35 which is fixed to the back plate 24 by a proper means. To the other side of said T-shaped lever 33 is pivotally connected a connecting rod 36 which is pivotally connected to one end of a lever fixed to a shaft of a motor (not shown). The connecting rod 36 is adapted to move up and down with the rotation of the motor. The lever 34, like said T-shaped lever 33, is pivotally connected at its middle portion to a pin 37 which is fixed to the back plate 24 by some proper means. With such construction, when the connecting rod 36 moves up and down, the T-shaped lever 33 is adapted to repeat the movement as shown by the double arrow R1 in FIG. 6 thereby to make the upper swing pin 29 move in the direction as shown by the double arrow R2 and the lower swing pins 31 move in the direction as shown by the double arrow R3 in FIG. 6. The upper swing pin 29 works to prevent filter rods from gathering only at the entrance to the hopper member and at the same time to distribute the filter rods to both sides of the hopper member. The lower swing pins 31 work to level and pile up the filter rods in every nook and corner in the lower part of the hopper member.

Figure 7:
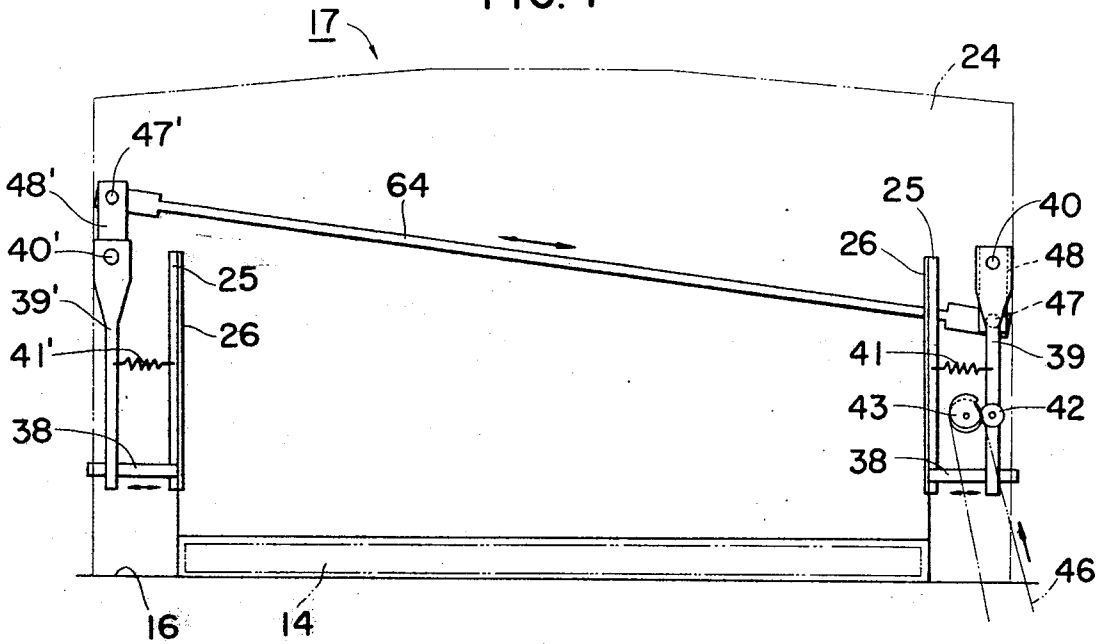
FIG. 7 is a semi diagrammatical view illustrating the operation of vibrating means.

Referring to FIG. 7, both vibrating plates 26 are fixedly connected, at their upper portions, to the side walls 25 and provided, at their lower portions, with knockers 38, respectively. The knockers 38 are fixed to lower end of a longer actuating rod 39 and a shorter actuating rod 39′, respectively. The longer actuating rod 39 repeatedly pivots at a pin 40 as a fulcrum, and the shorter actuating rod 39′ repeatedly pivots at a pin 40′ as a fulcrum. According to the movements of the actuating rods 39 and 39′, the knockers 38 knock the vibrating plates 26 to impart proper vibration to the vibrating plates. Thus, such vibration helps to make the orderly and precise piling of the filter rods in the hopper member. The longer actuating rod 39 is pulled towards the side wall 25 by a spring 41. A roller 42 is attached to the longer actuating rod 39 at the position lower than the spring 41. Said roller 42 always comes in contact with a rotating cam 43. A shaft 45 (FIG. 3) of the cam 43 is pivotally supported by a bearing 44 fixed to the side wall 25, and said cam 43 is actuated, through a belt 46, by the motor which drives the connecting rod 36. Namely, the vibrating plates 26, the upper swing pin 29 and the lower swing pins 31 have one motor in common as a driving source. While, the shorter actuating rod 39' is operated by transmitting the movement of the longer actuating rod 39 thereto in such a manner as described herein-below. The movement of the longer actuating rod 39 is transmitted to the shorter actuating rod 39' through an intermediate actuating rod 48 one end of which is fixed to the pin 40 and the other end of which is pivotally connected to one end of a linking rod 64 by means of a pin 47, the linking rod 64, and an intermediate actuating rod 48' one end of which is pivotally connected to the other end of the linking rod 64 by means of a pin 47' and the other end of which is fixed to the pin 40'. The pin 40' is fixed to the shorter actuating rod 39' which is always pulled towards the side wall 25 by means of a spring 41' provides at substantially the middle thereof. The pin 47 is pivotally supported by bearings 49 and 50 (FIG. 3), and the pin 47' is also pivotally supported by bearings (not shown). Numeral 51 (FIG. 2) designates a tightener for tightening the belt 46.

Figure 1:
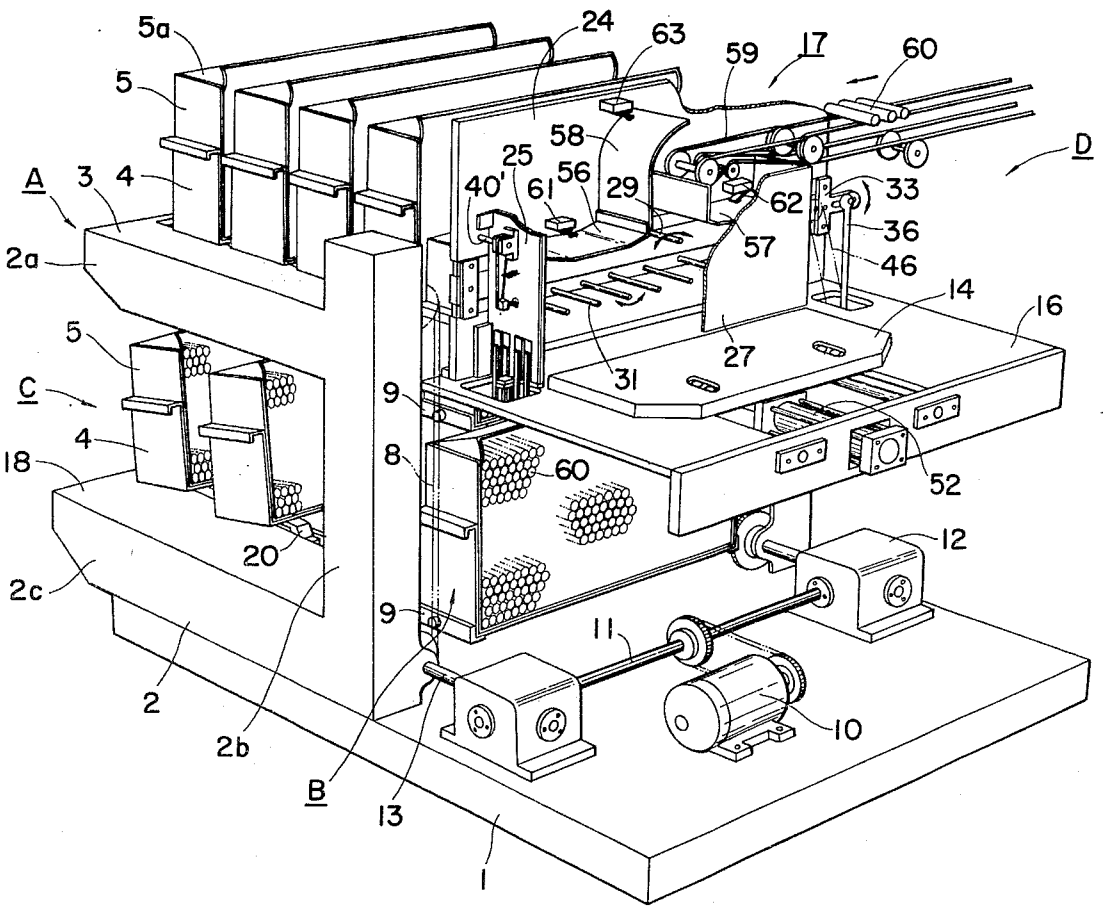
FIG. 1 is a perspective view of the apparatus according to the present invention, partially cut away.
Figure 2:
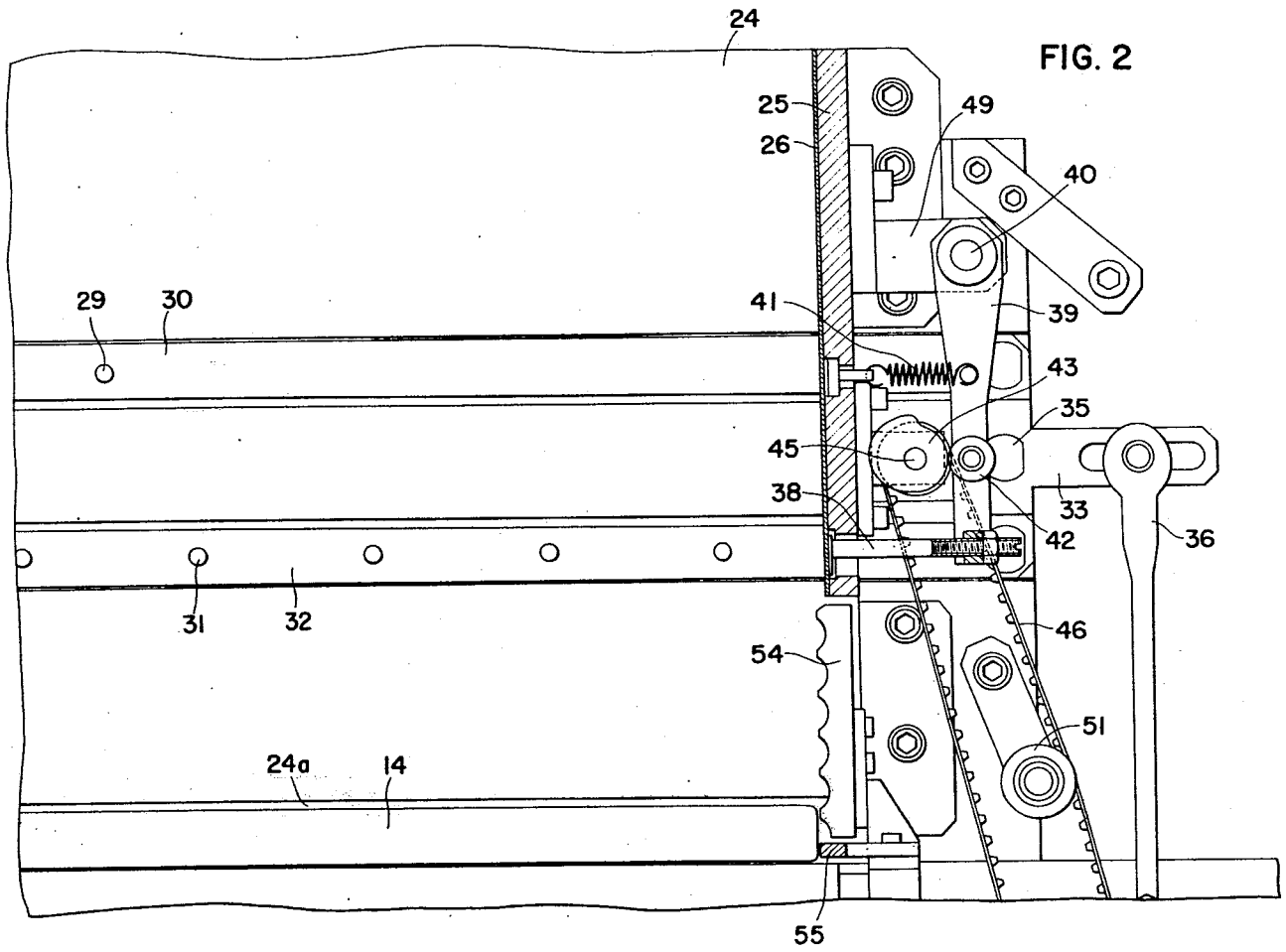
FIG. 2 is an elevation of a main part of the member designated by numeral 17 in FIG. 1.
Figure 3:
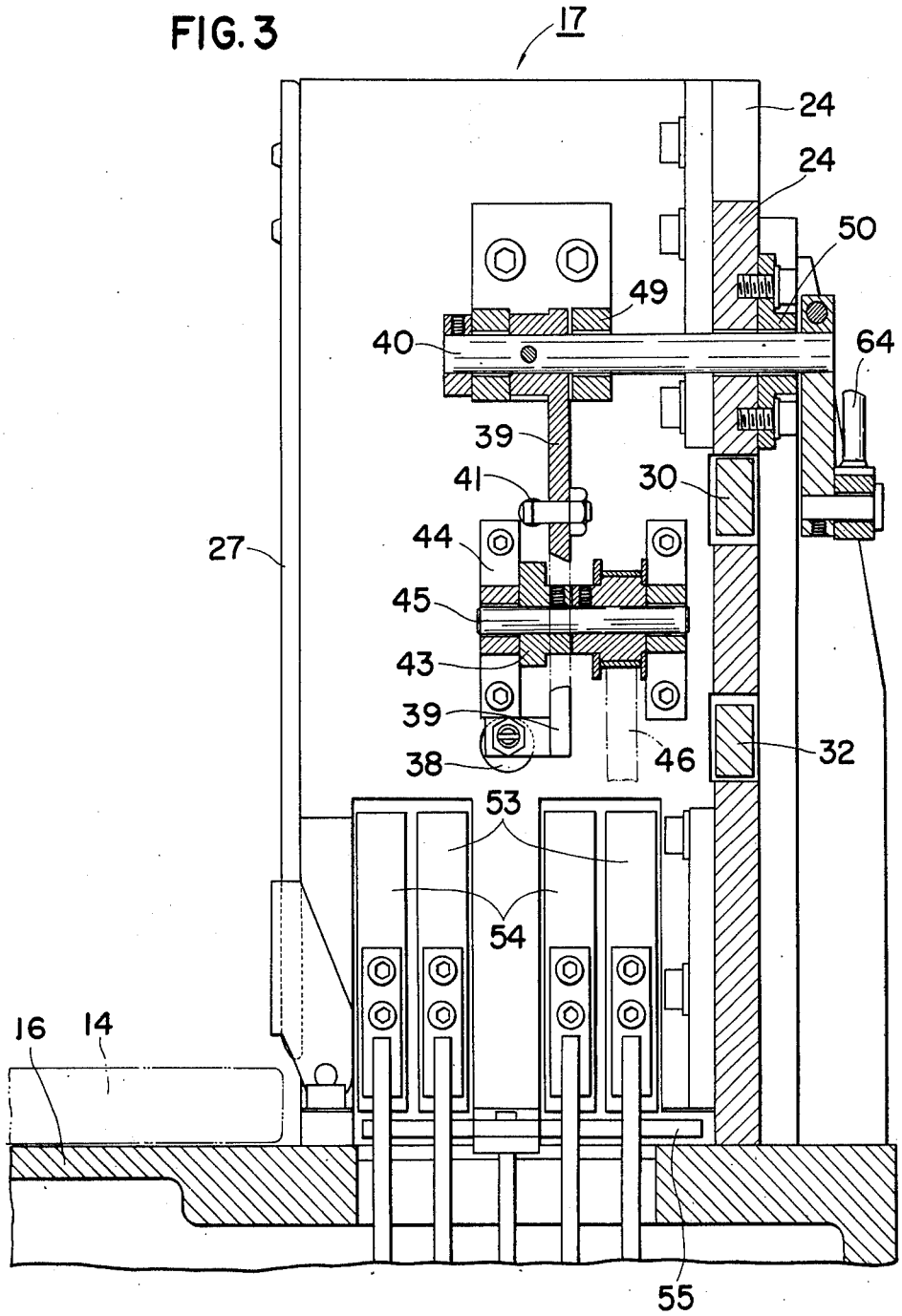
FIG. 3 is a sectional side view of the part of FIG. 2.
Figure 4:
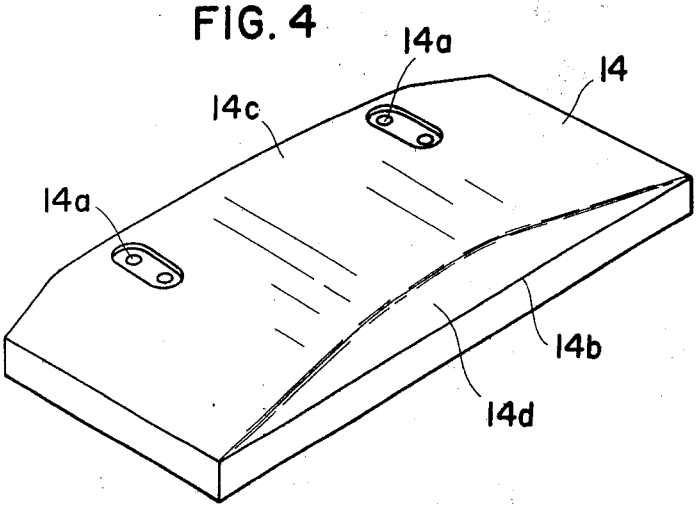
FIG. 4 is a perspective view of a push means.

The push means 14 is slidably provided on the front table 16 and is adapted to push the lowest three layers of the filter rods piled in the hopper member into the box at the lift down section (B). The protrude-retreat action of the push means 14 is conducted by an air-pressure cylinder 52. Referring to FIG. 1 and FIG. 4, the push means 14 is connected to rods of the air pressure cylinder 52 through narrow openings 14*a*. The push means 14 has a width a little shorter than that between the vibrating plates 26 in the hopper member and a thickness a little thinner than that of the three layers of the filter rods. The push means 14 further has its upper surface slightly rising towards its center portion from both side edges thereof except the rear portion where a slant 14*d* is formed to a rear edge 14*b*.

Below the side walls 25 and the vibrating plates 26, there are provided adjusting plates 53 and 54 and at the lower side corners of the hopper member there are provided adjusting plates 55. These adjusting plates 53, 54 and 55 are useful for keeping the lower layers of the filter rods in an orderly pile while said filter rods are falling after the previous three layers have been pushed into the box.

Figure 8:
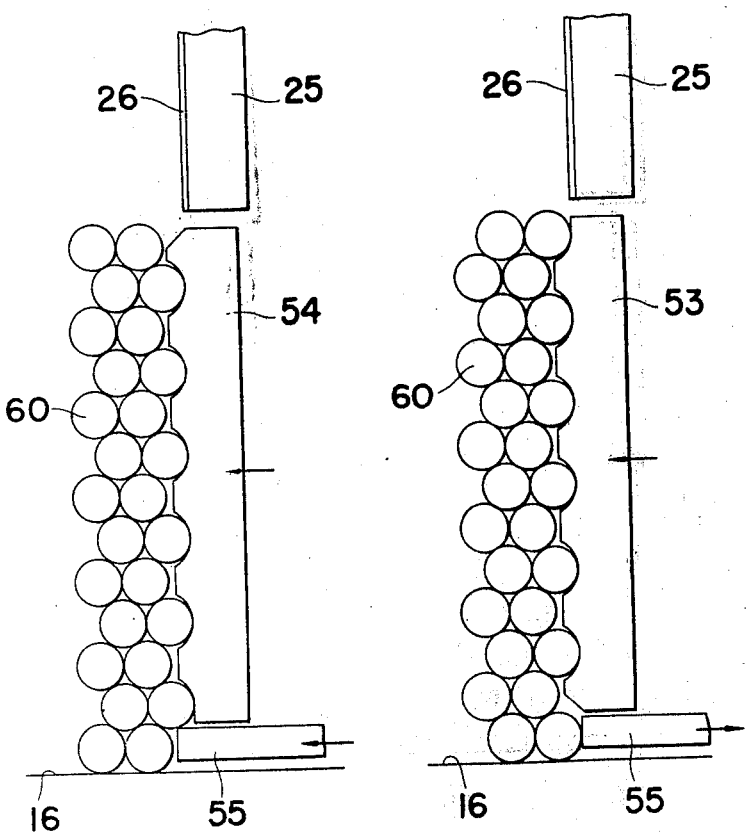
FIGS. 8*a* and 8*b* are semi diagrammatical views illustrating the operation of the adjusting plate.

Now there will be illustrated the operation of the adjusting plates, referring to FIG. 8. When the filter rods are arranged and piled on the bottom plate of the hopper members from corner to corner, the adjusting plates 53 protrude to support the pile of the filter rods. There are provided four adjusting plates 53 in total; two at each side of the hopper member 17. When the lowest three layers was pushed out and the number of the filter rods now on the bottom plate is smaller by one, the adjusting plates 54 protrude to support the pile. Said adjusting plates 54 are also four in number; two at each side. The adjusting plates 55 protrude just before the protrusion of the adjusting plates 54, to wit, just after the protrusion and the retreat of the push means 14, so as to reduce the breadth of the hopper bottom by a predetermined value corresponding to the diameter of one filter rod. Each side of the hopper member is provided with one adjusting plate 55 at its lowest portion.

Figure 6:
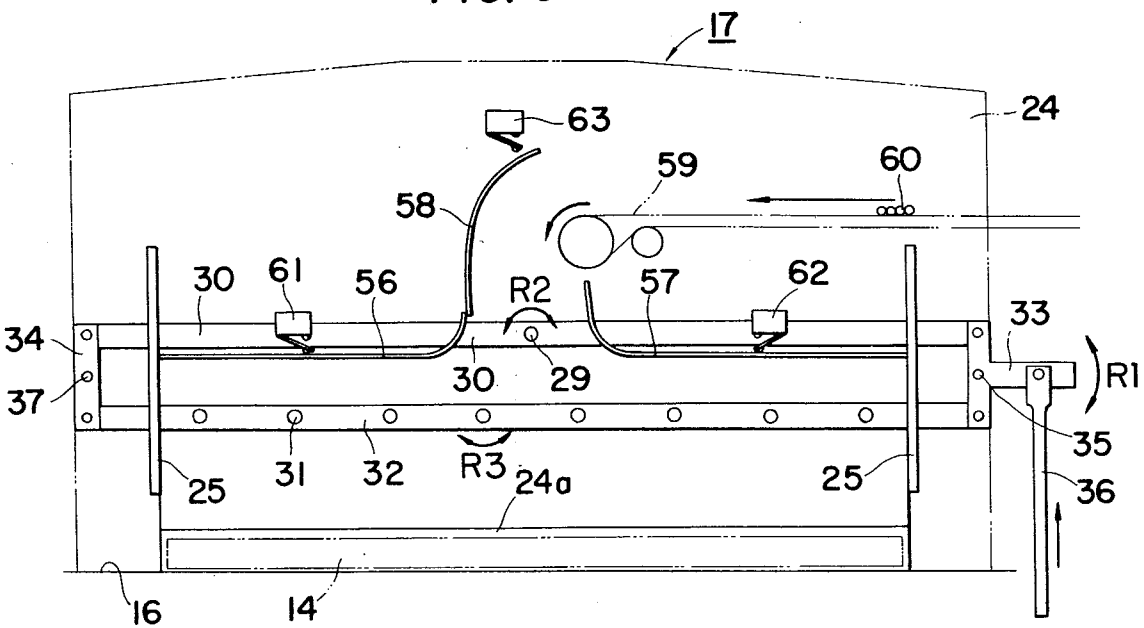
FIG. 6 is a semi diagrammatical view illustrating the operation of a levelling means in a hopper member.

Referring to FIG. 6, at a position which is a little higher than the middle point of each of the side walls there are fixedly provided one end of detecting plates 56 and 57, respectively. Said detecting plates 56 and 57 are adapted to be pushed up by the filter rods sufficiently piled in the hopper member. Numeral 58 designates a detecting plate the lower end of which is fixed to the back wall 24 at its substantially center portion as depicted in the drawings. Said detecting plate 58 is adapted to guide filter rods 60 which have been carried by a belt 59 into the hopper member and to be pushed up upon detecting that the filter rods 60 are collected too much at the entrance portion between the detecting plates 56 and 57. Numerals 61 and 62 designate micro switches fitted to the back wall 24, which are turned on when the detecting plates 56 and 57 are pushed up. The push means 14 protrudes whenever both the micro switches 61 and 62 are turned on, and retreats by the action of another micro switch provided in the front table 16. Numeral 63 designates a micro switch fitted to the back wall 24, which is turned on when the detecting plate 58 is pushed up, thereby to accelerate the rotation of the motor (not shown) which is a driving source of the belt 46 and the connecting rod 36. Illustratively stated, when the micro switch 63 is turned on, the upper swing pin 29 and the lower swing pins 31 swing at a high speed, and the vibrating plates 26 vibrate at a high speed, whereby the filter rods pushing up the detecting plate 58 are speedily distributed and the micro switches 61 and 62 are turned on in a short period. Since the micro switches 61 and 62 are turned on in a short period, the push means 14 also protrudes and retreats in a short period thereby to accelerate the case-up operation.

Longer filter rods are produced by a filter rod manufacturing machine (not shown) which operates interlockingly with the present apparatus. The filter rods thus produced are cut into shorter ones having the fixed size and are arranged in parallel with one another on the belt 59 and successively carried into the hopper member 17.

Figure 9:
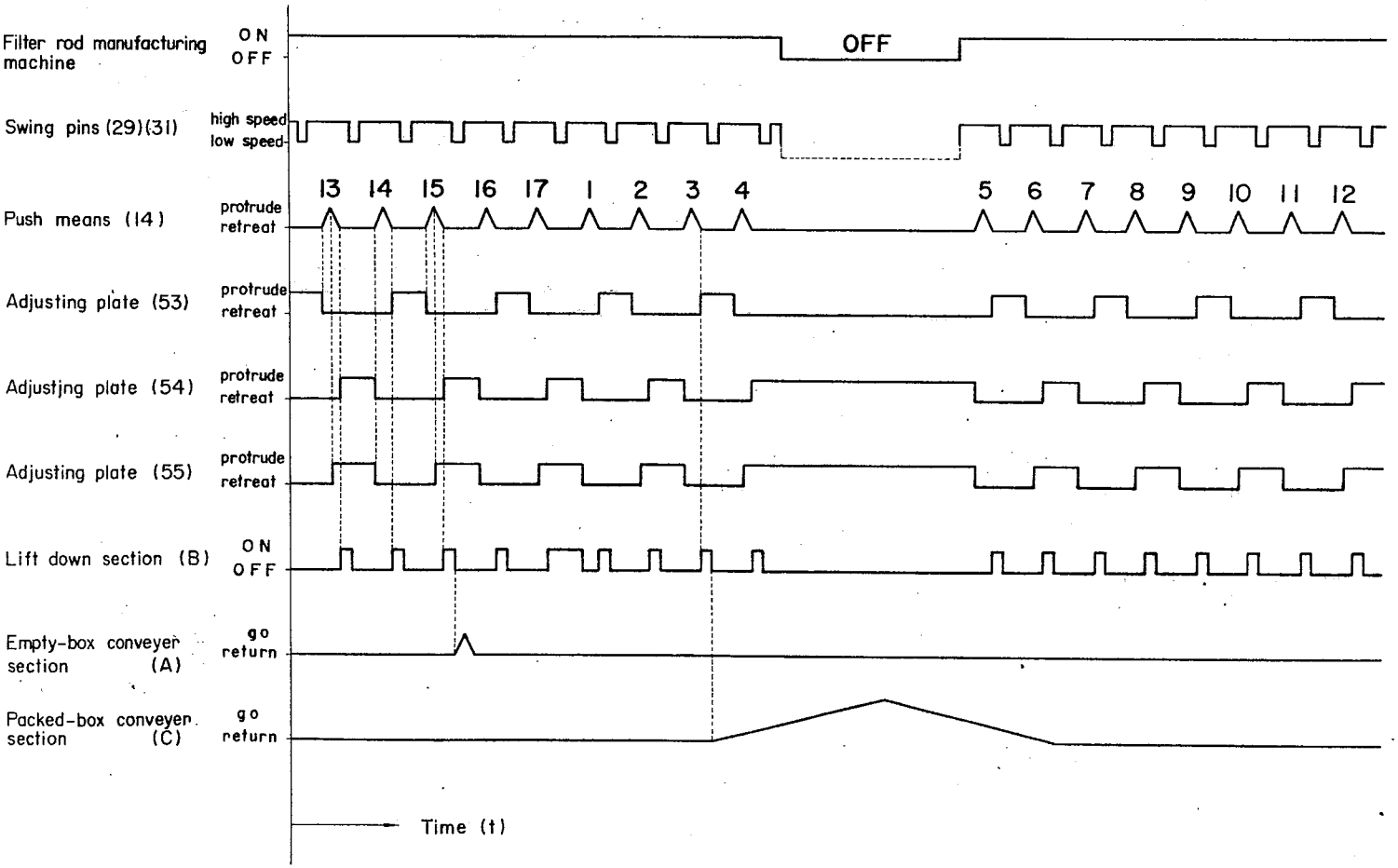
FIG. 9 is a time chart showing a series of operations of each member in the present apparatus.

Referring to the time chart in FIG. 9, there will be illustrated a series of operations of each member in the present apparatus. Before starting the operation of the filter rod manufacturing machine, one empty box 5 is set in the lift down section (B) in such a manner that the inner surface of the lower wall is positioned on the same level with the bottom face of the hopper member. While, on the delivery table 3 of the empty-box conveyor section (A) the other empty boxes fitted in the holding means 4 are each mounted between the pins 3*b*.

Together with the filter rod manufacturing machine, the apparatus begins to work. The upper swing pin 29 prevents the filter rods 60 from being collected at the entrance portion of the hopper member 17 while distributing said filter rods to the both sides in the hopper member. The lower swing pins 31 help the filter rods to be precisely piled in order in the hopper member. If the adjusting plates 53 are in protruded position at this entrance, the filter rods in the lowest layer are arranged from corner to corner without leaving any space at the both sides. The number of the filter rods in the second layer from the bottom is smaller by one than that in the lowest layer, and the next (third) layer has the same number of filter rods as the lowest layer. Accordingly, the filter rods are piled up in the hopper member from the bottom in such a manner that every second layer has the same number of the filter rods and every adjoining layer has a different number of filter rods.

Referring to No. 13 in FIG. 9, when the filter rods 60 are successively carried into and piled up in the hopper member 17, the detecting plates 56 and 57 are pushed up to turn on both the micro switches 61 and 62. In this instance the push means 14 protrudes to push the lowest three layers of the filter rods into the box 5 which has been waiting at the lowering section (B). At the beginning of the protrusion of the push means 14, the adjusting plate 53 retreats, and at the completion of the protrusion of the push means the adjusting plate 55 advances. This is because that, since the lowest three layers has been pushed away and the number of the filter rods in the next lowest layer is reduced by one now, the width of the hopper bottom needs to be narrowed by a value corresponding to the diameter of one filter rod. Just after the push means retreated and the second three layers of the filter rods fell down to the bottom, the adjusting plates 54 advances to keep the piled-up state of the filter rods as it stands. At the completion of the protrusion of the push means 14, the box 5 descends by the height corresponding to that of three layers of the filter rods. Illustratively stated, when the push means protrudes at the most, a micro switch (not shown) detects it and the motor 10 begins to rotate, thereby to operate the container-lowering means. While, when the photoelectric element 19 detects the small opening 15*a* in the disc 15, the motor 10 stops to cease the operation of the container-lowering means.

Referring to No. 14 in FIG. 9, at the next protrusion of the push means 14, the adjusting plate 54 which has protruded begins to retreat and the adjusting plate 55 also retreats. At the completion of the retreat of the push means 14, the adjusting plate 53 protrudes again. The above operations are repeated.

When the push means 14 has repeated the protrude-retreat action fifteen times, and the box further descends by the height corresponding to the thickness of the three layers of the filter rods, another empty box is carried from the empty box conveyor section (A) to the lowering section (B) by means of the delivery means 3*a*, 3*a'* and the pin 3*b*. When the last retreat of the push means 14 has been completed, the former box packed with 51 layers of the filter rod descends to the packed-box conveyor section (C) to be mounted on the packed-box delivery table 18. The box is inclined at about five degrees in relation to its advance direction. In this instance, said next empty box also descends the same distance as the former box so as to have its inner surface 5*b* of the lower wall positioned on the same level as the hopper bottom.

When the push means 14 has repeated its operation three times and nine layers (3 × 3) of the filter rods have been piled in said next box, the former box which has been mounted on the delivery table 18 begins to be carried to the terminal end of the delivery table 18 in such a manner that by the rotation of the gears 22 and 23 the engaging means 20 fixed to the chain 21 engages with the engaging means 4*a* of the holding means 4 to carry the box. When the box reaches the termination, the gears 22 and 23 rotate in reverse to return the engaging means 20 to the former position for waiting for the next packed box.

As is explained above, according to the present invention, one empty box is delivered from the empty-box conveyor section (A) to the lowering section (B); while it intermittently descends, the empty box is packed with every three layers of the filter rods (51 layers in total) by the action of the push means 14, while keeping the orderly piled state, said filter rods having already piled in the hopper section (D); and the packed box is carried to the terminal of the packed-box conveyor section (C). Therefore, one person suffices to watch the apparatus, setting an empty box on the empty-box delivery table 3, taking a packed box out of the delivery table 18 and pushing down the upper wall 5*a* into the box. Accordingly, the box packed with the fixed number of filter rods in an orderly pile can be successively obtained at a high speed.

Now, referring to FIG. 4, there will be illustrated the shape of the push means 14 and the effect thereof. As previously explained, the upper surface 14*c* of the push means 14 rises towards its middle portion from both sides. Why such a configuration is helpful is that when the lowest three layers of the filter rods have been pushed out into the box and other filter rods are falling towards the hopper bottom, there exists friction between the inner surfaces of the side walls of the hopper member and filter rods at both side portions, and therefore said filter rods at both side portions are a little slow in descending in comparison with other filter rods which fall in natural state. On the contrary, gravitations of filter rods in upper layers concentrate upon filter rods at middle portion in lower layers, and therefore said filter rods at middle portion are a little fast in descending in comparison with said other filter rods. Accordingly, there is a danger that the piled-up state may be disordered during the course of falling.

However, due to the rising surface 14*c* of the push means 14, the filter rods are piled in such a manner that the filter rods at both sides are a little lower than those at the middle portion. Therefore, even though such friction and concentrated gravitations should be caused, the filter rods at every portion can reach the hopper bottom substantially at the same time while maintaining the orderly piled state.

While one embodiment of the invention has been illustrated and described in detail, it is particularly understood that the invention is not limited thereto and thereby.

For example, filter rods may be carried into the hopper member from two or more directions. In this case, the detecting plate 58 may be removed off and the micro switch 63 may be replaced by a photoelectric type detector. Filter rods may be carried into the hopper member from both sides thereof not from a center portion.

Further, a plurality of swing pins 29 may be provided in order to efficiently distribute the filter rods.

Figure 10:
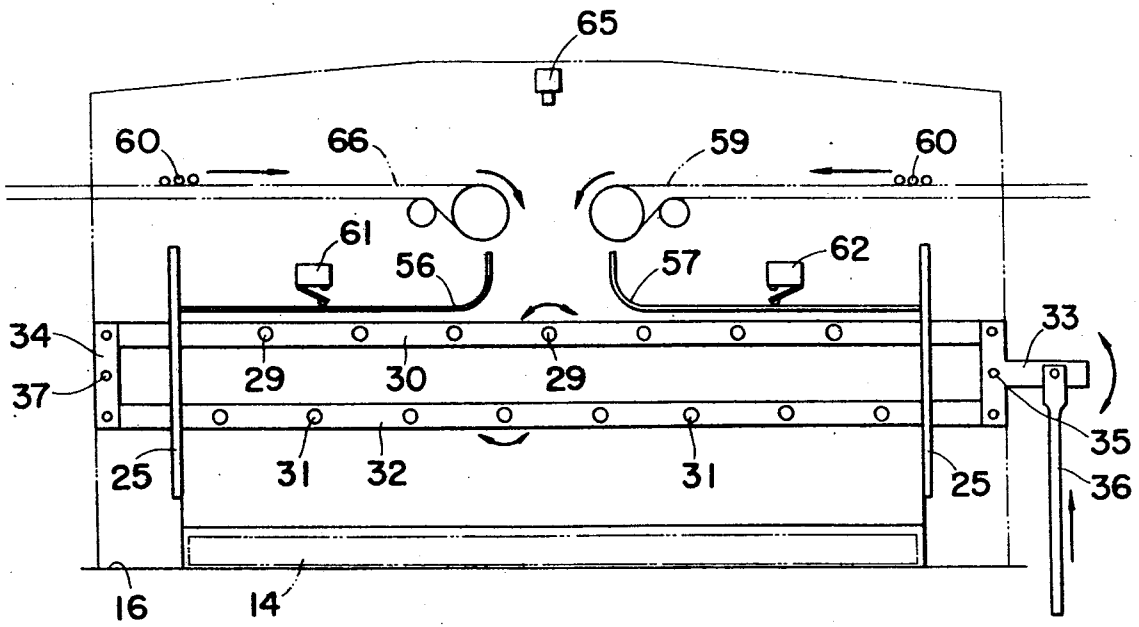
FIG. 10 is a semi diagrammatical view illustrating another embodiment of the hopper member according to the present invention.

Referring to FIG. 10, filter rods are carried in by a belt 59 and a belt 66. Above the entrance portion there is provided a photoelectric detector 65, and a plurality of swing pins 29 are employed.

Still further, the number of the layers of filter rods to be pushed into a box at one time may not be limited to three, to wit, may vary depending upon the size of the box, the size of the filter rod, etc. When even number of layers is to be pushed into a box at one time, the adjusting plate 55 is fixed at its retreated position and the adjusting plate 54 is not necessary.

What is claimed is:

1. In an apparatus for piling up rod-shaped articles within a hopper means so that the articles are maintained in an orderly pile having a honeycombed configuration, the hopper means including a bottom wall and a pair of upwardly projecting sidewalls between which said pile of articles is formed, means for supporting a container means disposed adjacent and vertically movable relative to said hopper means for receiving therein the articles which are piled within the hopper means, pushing means for transferring at least the lowermost row of articles from said hopper means into said container means, said pushing means including a pushing element movable transversely across the bottom wall for displacing at least the lowermost row of articles from said hopper means into said container means, and leveling means associated with the hopper means for distributing and leveling the rod-shaped articles within the hopper means, comprising the improvement wherein said hopper means includes adjusting means associated therewith for maintaining the lowermost rows of articles in an orderly pile after they have moved downwardly in the hopper means due to the lowermost row of articles being pushed into said container means, said adjusting means including a pair of movable members provided adjacent the lower part of the hopper means and movable between an inner position wherein they protrude inwardly from the sidewalls of the hopper means and an outer position wherein they are spaced outwardly from said inner position, said movable members being engageable with the lowermost rows of articles within said pile when said members are in said inner position for holding said lowermost rows in an orderly fashion, means for moving said members between said inner and outer positions in a selected relationship with respect to the movement of said pusher means, said members being movable in a direction which is substantially perpendicular to the direction of movement of said lowermost row when it is displaced by said pusher means, said movable members having a nonlinear surface profile which extends in the vertical direction of the hopper means and defines adjacent projection means and recess means disposed for cooperation with a pair of vertically adjacent rows as disposed adjacent the bottom of said pile.

2. An apparatus according to claim 1, wherein said adjusting means includes a second pair of movable members disposed adjacent the lower part of said hopper means and movable between an innermost position wherein they protrude inwardly beyond the adjacent sidewall for coacting with the lowermost row of articles and an outermost position which is spaced outwardly from said innermost position, said first-mentioned and second members being moved into said inner and innermost positions, respectively, in an alternating manner in correspondence with the repetitive advancing movement of the pushing element, and said pushing element having a configuration for slidably displacing an odd number of rows from said hopper means.

3. An apparatus according to claim 2, wherein said first-mentioned and second movable members are disposed adjacent the lower part of each sidewall so that a pair of said first-mentioned movable members and a pair of said second movable members are disposed in opposed relationship for movement in opposite directions.

4. An apparatus according to claim 3, wherein said pushing element has an upper surface which is gradually raised toward the middle thereof when viewed in a transverse plane with respect to its direction of movement.

5. An apparatus according to claim 4, wherein said leveling means comprises at least one upper swing pin and a plurality of lower swing pins disposed at an elevation below said upper swing pin.

6. An apparatus according to claim 5, including drive means drivingly interconnected to said upper and lower swing pins for causing said upper swing pin to reciprocally swing through a downwardly opening arcuate path and for causing said lower swing pins to reciprocally swing through upwardly opening arcuate paths, said drive means causing said upper and lower pins to be displaced in the same rotational direction but in opposite horizontal directions.

7. An apparatus according to claim 6, including vibrator means drivingly connected to said sidewalls for vibrating same.

8. An apparatus according to claim 1, wherein said pushing element has an upper surface which is gradually raised from both side edges toward the middle as viewed in a cross-sectional plane which extends transverse to the direction of movement.

9. An apparatus according to claim 1, wherein said leveling means includes at least one upper swing pin disposed adjacent the upper inlet end to said hopper means and a plurality of lower swing pins disposed at an elevation below said upper pin and extending transversely across said hopper means, and drive means drivingly interconnected to said upper and lower swing pins for causing said upper swing pin to swing through a downwardly opening arcuate path and for causing said lower swing pins to swingably move through upwardly opening arcuate paths.

10. In an apparatus for piling up rod-shaped articles in an orderly pile within a container, said apparatus including hopper means in which the articles are temporarily piled, push means movable in a horizontal direction transversely across the lower portion of said hopper means for displacing at least the lowermost row of articles from said hopper means into said container, leveling means coacting with said hopper means for distributing and leveling the rod-shaped articles therein, and means for lowering said container in synchronization with the reciprocating movement of said push means for enabling the rows of articles displaced from said hopper means to be disposed in an orderly pile within said container, comprising the improvement wherein said leveling means includes at least one upper swing pin disposed adjacent the upper inlet end of said hopper means and a plurality of lower swing pins disposed below said upper swing pin within a plane which extends substantially transversely across said hopper means, adjusting means disposed adjacent the lower part of said hopper means on the inside thereof for maintaining the temporary pile of rod-shaped articles in an orderly fashion, said adjusting means including a pair of movable plates which protrude and retreat in synchronism with the push means, vibrator means coacting with said hopper means to assist the temporary pile of articles within the hopper means to move downwardly toward the lower portion thereof, and said pushing means having an upper surface which is gradually raised toward the middle thereof from both side edges as viewed in a plane which extends transversely with respect to the direction of movement of said push means.

11. An apparatus as claimed in claim 10, wherein said means for lowering the container comprises an upright support means, a pair of gears which are attached to said support means at its upper and lower portions, respectively and an endless chain wound over said gears and having at least one catch means for catching the container.

* * * * *